US007584951B2

(12) United States Patent
Otani et al.

(10) Patent No.: US 7,584,951 B2
(45) Date of Patent: Sep. 8, 2009

(54) CONVEYANCE CONTROL DEVICE, RECORDING APPARATUS INCLUDING THE SAME, AND CONVENYANCE CONTROL METHOD

(75) Inventors: Tsuyoshi Otani, Kawasaki (JP); Hiroyuki Kakishima, Kawasaki (JP); Shinya Sonoda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 11/769,507

(22) Filed: Jun. 27, 2007

(65) Prior Publication Data

US 2008/0006994 A1 Jan. 10, 2008

(30) Foreign Application Priority Data

Jul. 6, 2006 (JP) ..... 2006-186913

(51) Int. Cl.
*B65H 5/00* (2006.01)
*B65H 7/02* (2006.01)

(52) U.S. Cl. ..... 271/10.01; 271/10.02; 271/10.03; 271/265.01

(58) Field of Classification Search ..... 271/264, 271/265.02, 3.14, 3.15, 3.17, 4.01, 4.02, 271/4.03, 10.01–10.03, 3.01, 3.06, 3.09, 271/3.13

See application file for complete search history.

(56) References Cited

U.S. PATENT DOCUMENTS 5,194,970 A * 3/1993 Iwanade ..... 358/498
6,135,439 A * 10/2000 Ikeda ..... 271/10.3
6,572,096 B1 * 6/2003 Johnson et al. ..... 271/25
7,334,787 B2 * 2/2008 Akiyama et al. ..... 271/10.02
7,415,239 B2 * 8/2008 Saito et al. ..... 399/388
2003/0085505 A1 * 5/2003 Inoue et al. ..... 271/10.01
2003/0184002 A1 * 10/2003 Akiyama et al. ..... 271/110
2004/0094887 A1 * 5/2004 Hidaka et al. ..... 271/10.01
2004/0251592 A1 12/2004 Ruhe et al.
2005/0206067 A1 * 9/2005 Cook et al. ..... 271/10.01
2007/0228649 A1 * 10/2007 Mizutani et al. ..... 271/314
2008/0111293 A1 * 5/2008 Shingai ..... 271/3.14
2008/0179817 A1 * 7/2008 Schalk et al. ..... 271/121

FOREIGN PATENT DOCUMENTS

JP 2005-008416 A 1/2005

* cited by examiner

*Primary Examiner*—Patrick H Mackey
*Assistant Examiner*—Patrick Cicchino
(74) *Attorney, Agent, or Firm*—Canon U.S.A. Inc., I.P. Division

(57) ABSTRACT

A conveying device which can determine whether an error occurred therein. When a transmission unit is in a transmission state, a sheet feed roller is driven by a DC motor to perform first driving for conveying a sheet up to a conveying roller. The occurrence of an error with respect to the sheet feed roller is determined based on information obtained from an encoder during the first driving. When the occurrence of an error is determined, second driving is performed. A conveyance error is determined based on a count value during the first driving and a count value during the second driving, which are both obtained from the encoder.

5 Claims, 7 Drawing Sheets

| | PERIOD 1 | PERIOD 2 | PERIOD 3 |
|---|---|---|---|
| A | 8000 | 10000 | 6000 |
| B | 500 | 0 | 0 |
| C | 2000 | 200 | 30 |

CONVEYANCE CONTROL DEVICE, RECORDING APPARATUS INCLUDING THE SAME, AND CONVENYANCE CONTROL METHOD

BACKGROUND OF THE INVENTION

1. Field of the Invention

The present invention relates to a recording apparatus, a conveyance device, and a conveyance control method.

2. Description of the Related Art

In recording apparatuses (printers), there are known automatic sheet feeders of the type that sheets are held in a substantially horizontally stacked state under a main body of the recording apparatus and are fed one by one (e.g., Japanese Patent Laid-Open No. 2005-8416), and of the type that sheets are held in an obliquely stacked state on the rear side of the recording apparatus and are fed one by one. Some of recording apparatuses includes both the types of automatic sheet feeders.

Further, there is known a method of performing the so-called U-turn sheet feed by holding recording sheets in a substantially horizontally stacked state under the main body of the recording apparatus and conveying the recording sheets one by one along a cylindrical concave surface for feed of the sheet. Such a sheet feed mode is suitable for feeding a thin sheet made of plain paper, for example.

The U-turn sheet feed mode has a longer conveying path than the other mode of holding sheets in an obliquely stacked state on the rear side of the recording apparatus and feeding the sheets one by one, and is more apt to cause a sheet jam in the conveying path. Therefore, the U-turn sheet feed mode requires a sheet detecting sensor which is disposed in the conveying path.

Further, in a sheet feed unit utilizing a swing arm, when a pickup operation by a pickup roller (sheet feed roller) is performed without setting of printing sheets (i.e., with no printing sheets placed in a tray), the swing arm comes into contact with the tray, thus resulting in a state that the sheet feed roller is not rotated (namely, it is locked).

At that time, a control system for controlling a motor, which serves as a roller driving source, falsely detects the occurrence of an error state. To avoid such a false detection, a driven roller for escaping a pressing force applied to the pickup roller is required to be disposed just below the pickup roller.

SUMMARY OF THE INVENTION

In view of the above-mentioned problems with the related art, the present invention provides a conveyance device, a conveyance control method, and a recording apparatus, which can correctly detect (or determine) an error state.

More specifically, according to an aspect of the present invention, a conveying device includes a sheet feed roller and a conveying roller which are driven by a DC motor, and controlling the DC motor based on information obtained from an encoder mounted to the conveying roller. The conveying device includes a transmission unit having a transmission state in which a driving force transmitted from the DC motor for driving the conveying roller is transmitted to the sheet feed roller and a non-transmission state in which the driving force is not transmitted to the sheet feed roller, the transmission unit being configured to switch between the transmission state and the non-transmission state depending on a rotating direction of the DC motor, a first driving unit configured to drive the DC motor in a first amount of driving in a first direction to convey a sheet up to the conveying roller when the transmission unit is in the transmission state, a counting unit configured to count a number of slits of the encoder, a first determining unit configured to determine the occurrence of an error with respect to the sheet feed roller based on a count value counted by the counting unit during the driving of the first driving unit, a second driving unit configured to drive the DC motor in a second amount of driving in a second direction opposed to the first direction to convey the sheet up to a position downstream of the conveying roller in a conveying direction when no error is determined by the first determining unit, a third driving unit configured to drive the DC motor in a third amount of driving in the second direction when the occurrence of an error is determined by the first determining unit, and a second determining unit configured to determine one of a plurality of error types based on the count value counted by the counting unit during the driving of the first driving unit and the count value counted by the counting unit during the driving of the third driving unit.

According to another aspect of the present invention, there is a conveyance control method for a conveying device including a sheet feed roller and a conveying roller which are driven by a DC motor, and a transmission unit having a transmission state in which a driving force transmitted from the DC motor for driving the conveying roller is transmitted to the sheet feed roller and a non-transmission state in which the driving force is not transmitted to the sheet feed roller, the transmission unit being configured to switch between the transmission state and the non-transmission state depending on a rotating direction of the DC motor, thus controlling the DC motor based on information obtained from an encoder mounted to the conveying roller. The conveyance control method includes a driving the DC motor in a first amount of driving in a first direction to convey a sheet up to the conveying roller when the transmission unit is in the transmission state, counting a first number of slits of the encoder, determining the occurrence of an error with respect to the sheet feed roller based on the first number of slits counted, driving the DC motor in a second amount of driving in a second direction opposed to the first direction to convey the sheet up to a position downstream of the conveying roller in a conveying direction when no error is determined, driving the DC motor in a third amount of driving in the second direction when the occurrence of an error is determined, counting a second number of slits of the encoder, and determining one of a plurality of error types based on the first number of slits counted and the second number of slits counted.

According to still another aspect of the present invention, a recording apparatus includes a sheet feed roller and a conveying roller which are driven by a DC motor, and controlling the DC motor based on information regarding an amount of rotation of the conveying roller to record an image on a recording medium by using a recording head. The recording apparatus includes a transmission unit having a transmission state in which a driving force transmitted from the DC motor for driving the conveying roller is transmitted to the sheet feed roller and a non-transmission state in which the driving force is not transmitted to the sheet feed roller, the transmission unit being configured to switch between the transmission state and the non-transmission state depending on a rotating direction of the DC motor, a first driving unit configured to drive the DC motor in a first amount of driving in a first direction to convey a recording medium in a sheet feed tray up to the conveying roller by the sheet feed roller when the transmission unit is in the transmission state, a first determining unit configured to determine the occurrence of an error with respect to the sheet feed roller based on an amount by which the conveying roller is rotated per unit time during the driving of the first driving unit, a second driving unit configured to drive the DC motor in a second amount of driving in a second direction opposed to the first direction to convey the recording medium by the conveying roller up to a recording area of the recording head downstream of the conveying roller in a conveying direction when no error is determined by the first determining unit, a third driving unit configured to drive the DC motor in a third amount of driving in the second direction when the occurrence of an error is determined by the first determining unit, and a second determining unit configured to determine one of a plurality of error types based on the amount by which the conveying roller is rotated per unit time during the driving of the first driving unit and an amount by which the conveying roller is rotated per unit time during the driving of the third driving unit.

Further features of the present invention will become apparent from the following description of exemplary embodiments with reference to the attached drawings.

DESCRIPTION OF THE EMBODIMENTS

An exemplary embodiment of the present invention will be described in detail below with reference to the accompanying drawings.

Figure 1:
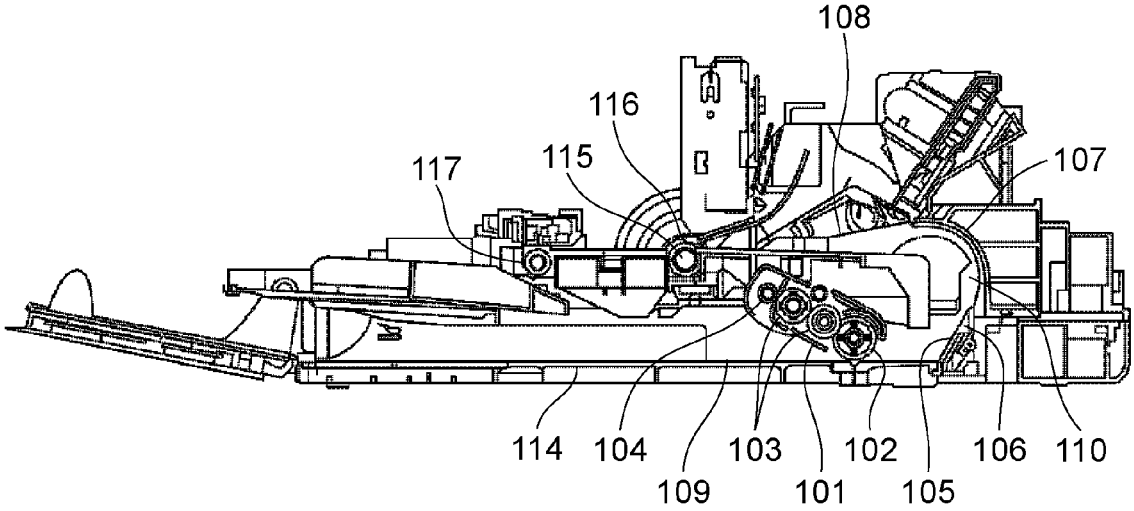
FIG. 1 is a side view showing the construction of a conveying device (for a recording apparatus) according to an exemplary embodiment of the present invention.

FIG. 1 is a side view of a recording apparatus (including a conveying device) to which the present invention can be applied. A sheet feed roller 102 mounted to a swing arm 101 picks up a top one 109 of recording media (printing media) placed in a sheet feed tray (sheet stacking portion) 114. The picked-up recording medium 109 is conveyed along a conveying path defined by a conveying guide 107, a conveying guide 108, and a conveying roller 115. The recording medium is, for example, a sheet made of plain paper, glossy paper, or coated paper.

In this exemplary embodiment, a PE sensor (photoelectric sensor) is disposed in the conveying path between the sheet feed roller 102 and the conveying roller 115. The conveying roller 115 contacts a pinch roller 116 and forms a nip for moving the recording medium 109 toward a sheet output roller 117.

The sheet feed roller 102 is rotated by receiving a driving force from a gear 104 through an idler gear 103. As described later, transmission of a driving force of an LF motor (linefeed motor) to the gear 104 is turned on/off in accordance with movement of the swing arm 101.

A separating member 105 is disposed downstream of the sheet feed roller 102 to prevent the next recording medium from being dragged into a medium path 110 together when the recording medium 109 at the top of the media stacked in the tray 114 is picked up by the sheet feed roller 102. The separating member 105 protrudes from the surface of a slope 106 such that the next recording medium dragged by a small frictional force acting between two sheets is brought into abutment against a protrusion and is prevented from coming into the medium path 110.

Figure 6:
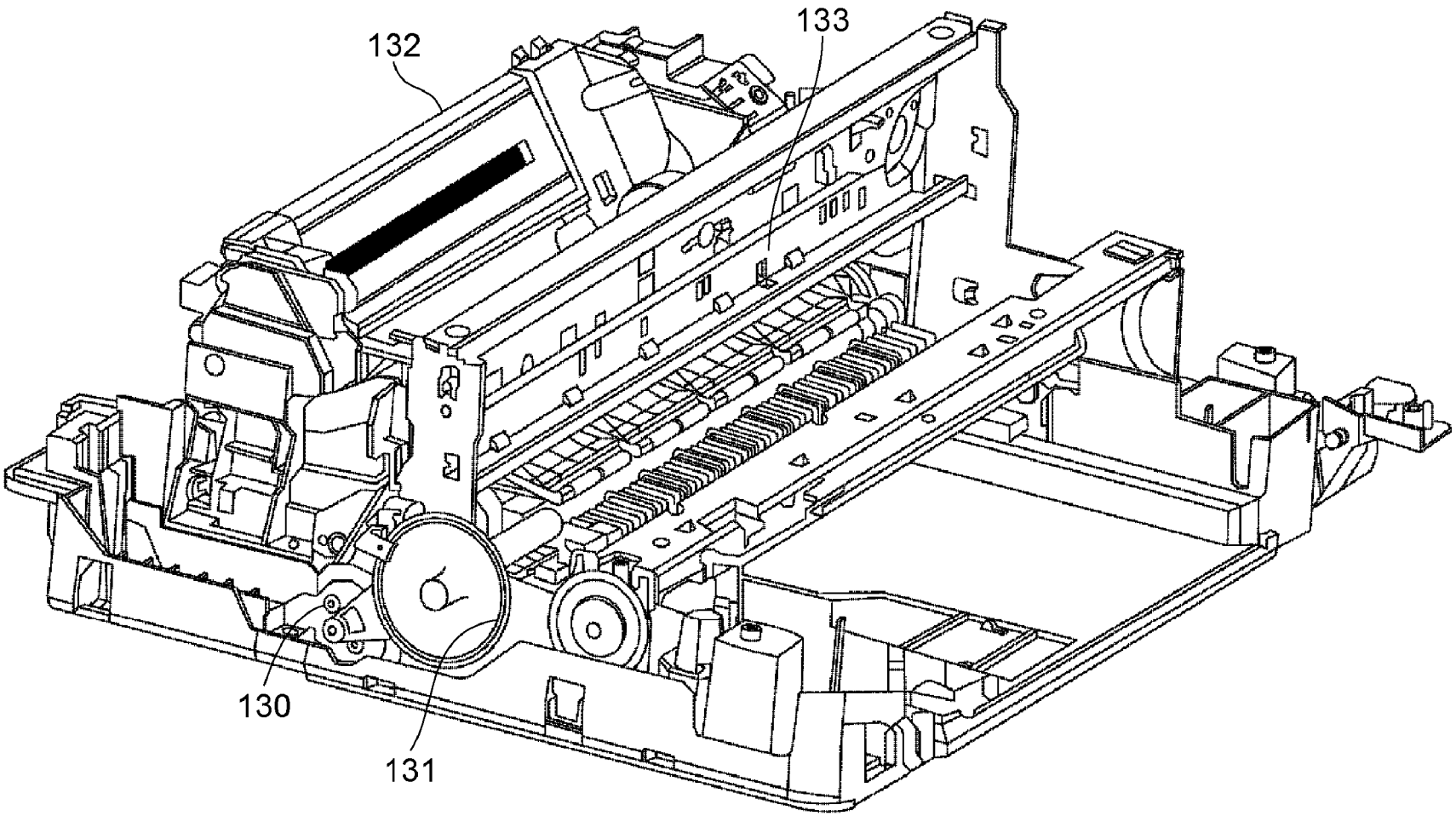
FIG. 6 is a perspective view showing the construction of the conveying device (for the recording apparatus) according to the exemplary embodiment of the present invention.

FIG. 6 is a perspective view of the recording apparatus (including the conveyance device), looking in a direction opposed to that in FIG. 1. A linefeed motor (LF motor) 130 is controlled in accordance with information (signal) obtained from a rotary encoder 131. The linefeed motor 130 thus controlled drives an auto sheet feeder (ASF) 132, the sheet feed roller 102, and the conveying roller 115. More specifically, when the recording medium is fed from the tray 114 by the sheet feed roller 102, a control unit performs control in accordance with both the information (signal) obtained from the rotary encoder 131 and a command value (preset profile) for the sheet feed roller 102. Also, when the recording medium is conveyed by the conveying roller 115 after the sheet feed operation, the control unit performs control in accordance with both the information (signal) obtained from the rotary encoder 131 and a command value (preset profile) for the conveying roller 115. The rotary encoder 131 is mounted to the conveying roller 115. When the sheet feed roller 102 is driven, the information (signal) obtained from the rotary encoder 131 is also used.

Through a mechanical driving system, the driving force of the LF motor 130 is always transmitted to the conveying roller 115. On the other hand, the driving force of the LF motor 130 is transmitted to the sheet feed roller 102 when the swing arm 101 is in a predetermined position.

A PE sensor 133 is used to detect the leading end of the recording medium in ASF sheet feed and U-turn sheet feed. The PE sensor 133 detects whether the recording medium is present in the conveying path.

Figures 7, 8:
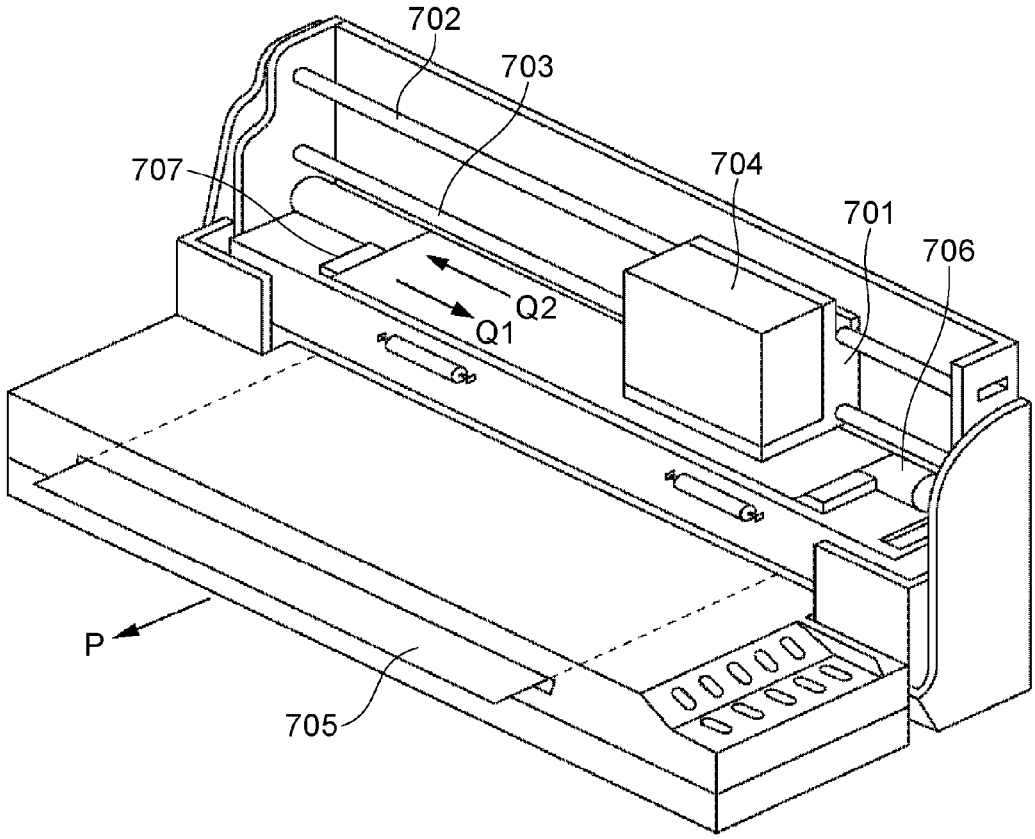
FIG. 7 is a perspective view of the recording apparatus according to the exemplary embodiment of the present invention.
FIG. 8 is a table illustrating the number of encoder slits detected in various modes of sheet feed operations in the exemplary embodiment of the present invention.

Referring to FIG. 7 which is a perspective view of the recording apparatus, a recording head 704 mounted on a carriage 701 includes discharge ports (nozzles) capable of discharging ink and an ink tank containing the ink. The recording head 704 is mounted on the carriage 701 with the discharge ports directed downward so that the ink is discharged for recording toward a recording medium 705 positioned below the recording head 704.

The carriage 701 is supported by two guide shafts 702 and 703 to be movable in the axial direction of the guide shafts. The carriage 701 is driven by a carriage motor (not shown) to reciprocally scan a scanning area, which includes a recording area, in a main scanning direction, i.e., in one of directions denoted by arrows Q1 and Q2. When one cycle of main scanning by the carriage 701 is completed, a conveying roller 706 conveys the recording medium 705 in a sub-scanning direction, i.e., a direction denoted by an arrow P, in a certain amount (i.e., a distance corresponding to the recording width of the recording head 704). Recording on one page is performed by repeating the operation of scanning the recording head and the operation of conveying the recording medium as described above. Reference numeral 707 denotes a platen.

Figure 2:
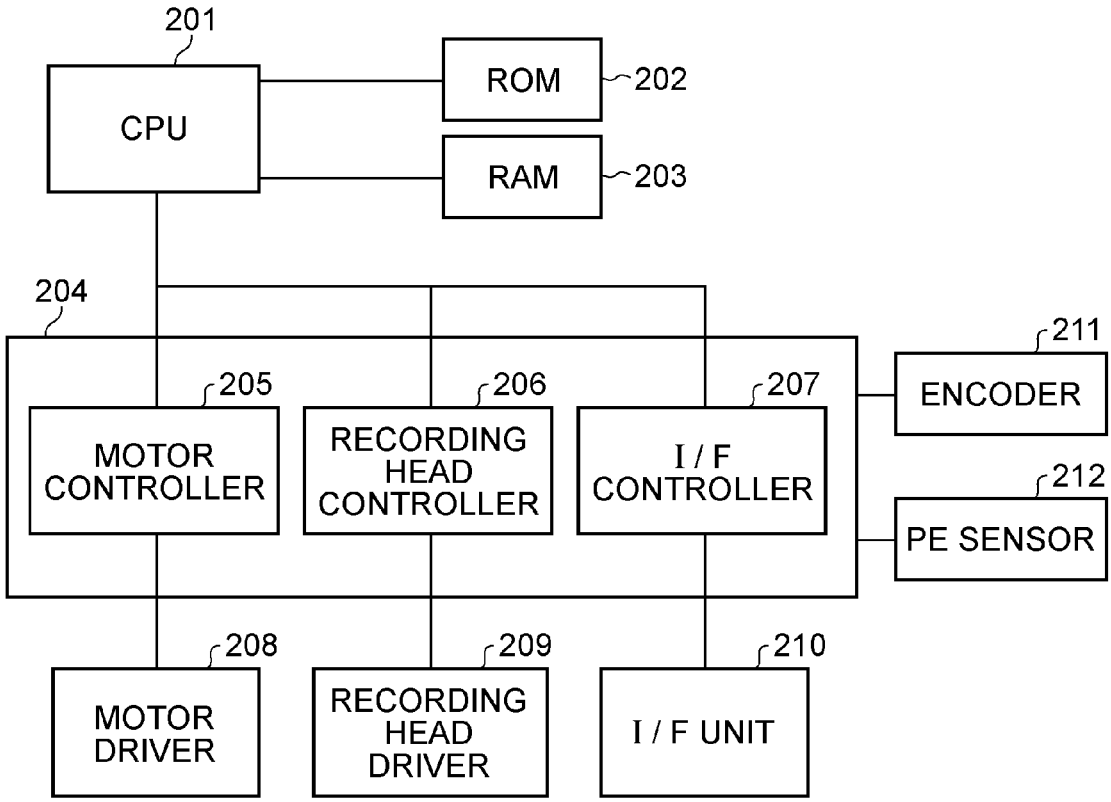
FIG. 2 is a block diagram illustrating a control block in the conveying device (for the recording apparatus) according to the exemplary embodiment of the present invention.

FIG. 2 is a control block diagram of the recording apparatus (printer) according to the exemplary embodiment of the present invention.

A CPU 201 controls the recording apparatus. A ROM 202 stores control software and various data (such as mask data). A RAM 203 includes, for example, a recording buffer which holds recording data, a receiving buffer which holds data input (received) from the exterior, and a work buffer which holds control parameters.

An ASIC (application specific integrated circuit) 204 includes a motor controller 205, a recording head controller 206, and an interface (I/F) controller 207.

The motor controller 205 communicates with the CPU 201 and outputs a drive signal to a motor driver 208. The recording head controller 206 communicates with the CPU 201 and outputs a drive signal to a recording head driver 209. In accordance with the drive signal, the ink is discharged from the recording head to form an image on a recording sheet. The interface (I/F) controller 207 communicates with the CPU 201 and controls an I/F unit 210. The I/F unit 210 executes communication with a host or communication with a memory card.

The I/F unit 210 communicating with the host is, for example, a USB interface or an IEEE1284 interface. The memory card is, for example, a CF (compact flash) card or an SD (secure digital) card.

The recording head is made up of a black recording head having 320 nozzles at 600 DPI and a color recording head having 256 nozzles for each of yellow (Y), magenta (M) and cyan (C) at 1200 DPI.

The recording head is scanned for recording in a direction differing from the direction in which the recording medium is conveyed.

Further, the ASIC 204 includes a circuit for processing signals from an encoder 211 and a PE sensor 212.

In addition, there is a control panel (not shown). The control panel includes a power supply key, a resume key for designating restoration, test print, recovery from an error, and LEDs for displaying reception of data, a power supply state, and the occurrence of an error.

Figure 3:
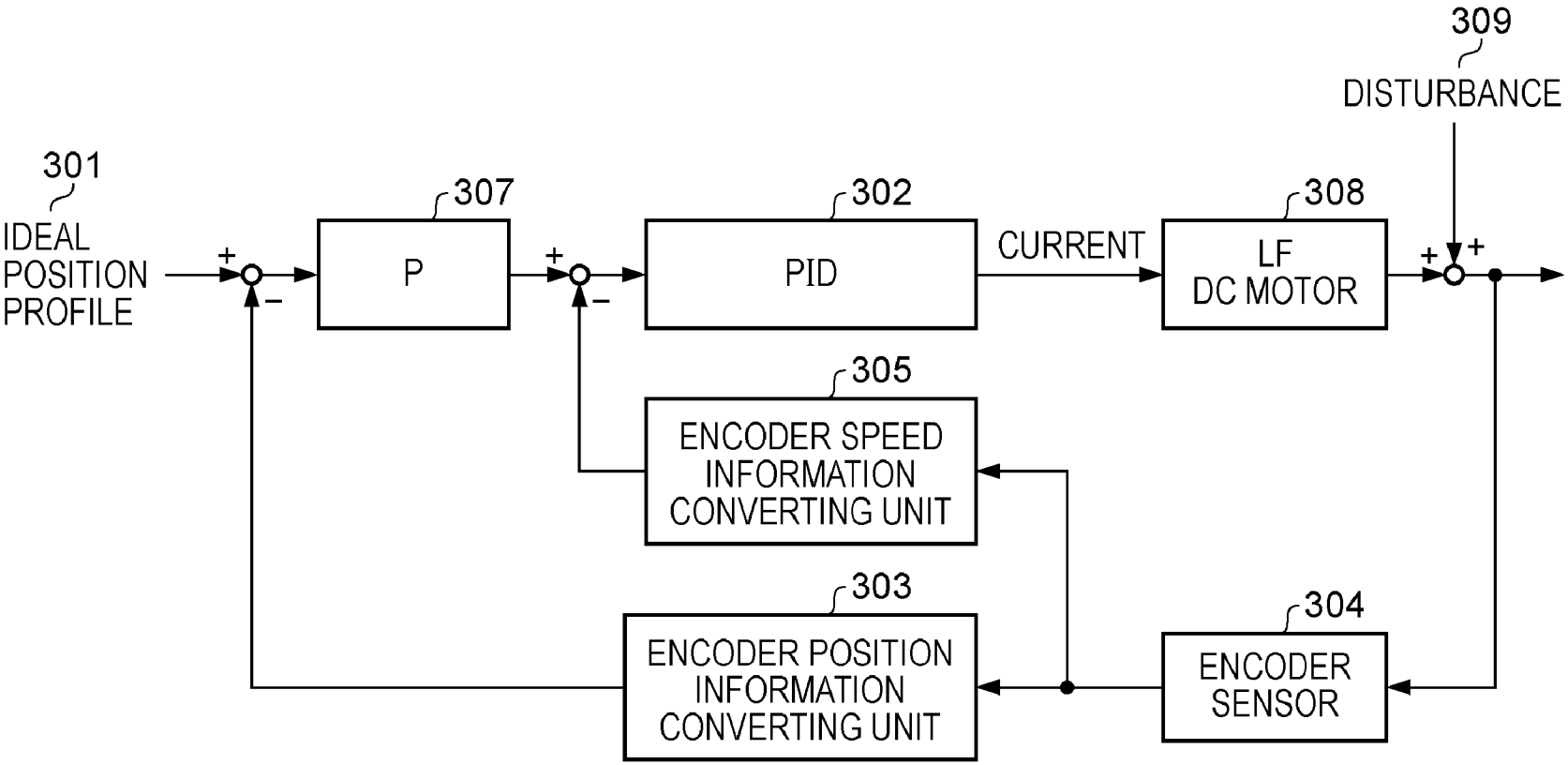
FIG. 3 is a block diagram illustrating a motor control system in the exemplary embodiment of the present invention.

FIG. 3 is a block diagram illustrating general feedback control of the LF motor by using a position servo system. The feedback control shown in FIG. 3 is merely one example and can also be practiced in other suitable control schemes.

First, a target position to be set for a control object is given by a position profile (ideal position profile) 301. The position profile provides a position command value at the present time. Position information is changed with the progress of time. The recording apparatus is driven by performing follow-up control with respect to the position profile.

The recording apparatus includes an encoder sensor 304 which detects physical rotation of the motor. An encoder position information converting unit 303 sums up the number of slits detected by the encoder sensor in a successive manner, thus obtaining absolute position information. An encoder speed information converting unit 305 serves as a unit for calculating a driving speed of the LF motor at the present time based on a signal from the encoder sensor and a signal from a timer built in to the printer.

A numerical value resulting from subtracting the actual physical position, which is obtained by the encoder position information converting unit 303, from the position profile 301 is transferred, as a position error deviated from the target position, to a position servo feedback process subsequent to a position servo measure loop 307. The position servo measure loop 307 is generally constituted by a known unit for calculating a proportional term P.

A speed command value is output as a result of the calculation executed in 307. The output speed command value is transferred to a speed servo feedback process subsequent to 302. A speed servo minor loop is generally performed by a unit executing PID calculations, i.e., calculations for the proportional term P, an integral term I, a differential term D.

In the speed servo minor loop, a numerical value resulted from subtracting the encoder speed information from the speed command value is transferred, as a speed error deviated from a target speed, to a PID calculation circuit 302 which calculates energy to be applied to a DC motor 308 at the present time through the PID calculations. Upon receiving the result of the PID calculations, a motor driver circuit changes a duty (i.e., a ratio of turning-on time to a turning-off time) of the applied voltage through PWM control. As a result, electric power supplied to the DC motor 308 is adjusted and motor speed control is performed.

The DC motor 308 is supplied with a current value and is physically rotated while suffering from the influence of a disturbance 309, and an output of the DC motor 308 is detected by the encoder sensor 304.

A process for determining an error in the sheet feed operation will be described below with reference to FIG. 4. In 401, a sheet feed sequence is started.

In 402, whether the recording medium is present in the conveying path is checked based on the information from the PE sensor. If it is determined that the recording medium is present (Yes), the processing flow advances to 411. In 411, a sheet jam error process is executed.

In the sheet jam error process, the LED on the control panel is illuminated to display the occurrence of an error, and a control mode is shifted to an error mode. In the error mode, driving of a conveying system mechanism is inhibited to prevent the recording medium from being damaged.

In the state where the driving of the conveying system mechanism is inhibited, since the apparatus operation is stopped, a user can remove the recording medium jammed in the conveying path. When the user presses the resume key after removing the recording medium, the inhibited state is canceled and the apparatus is returned to a normal state.

If it is determined in 402 that the recording medium is not present (No), the processing flow advances to 403. In 403, a pickup operation is started. In this exemplary embodiment, by rotating the LF motor backward, the sheet feed roller is rotated to pick up the recording medium from the tray. The picked-up recording medium sheet is conveyed along the conveying path which is extended up to the sheet output tray, while passing the PE sensor, an LF roller, and a recording (printing) position.

Figure 5A:
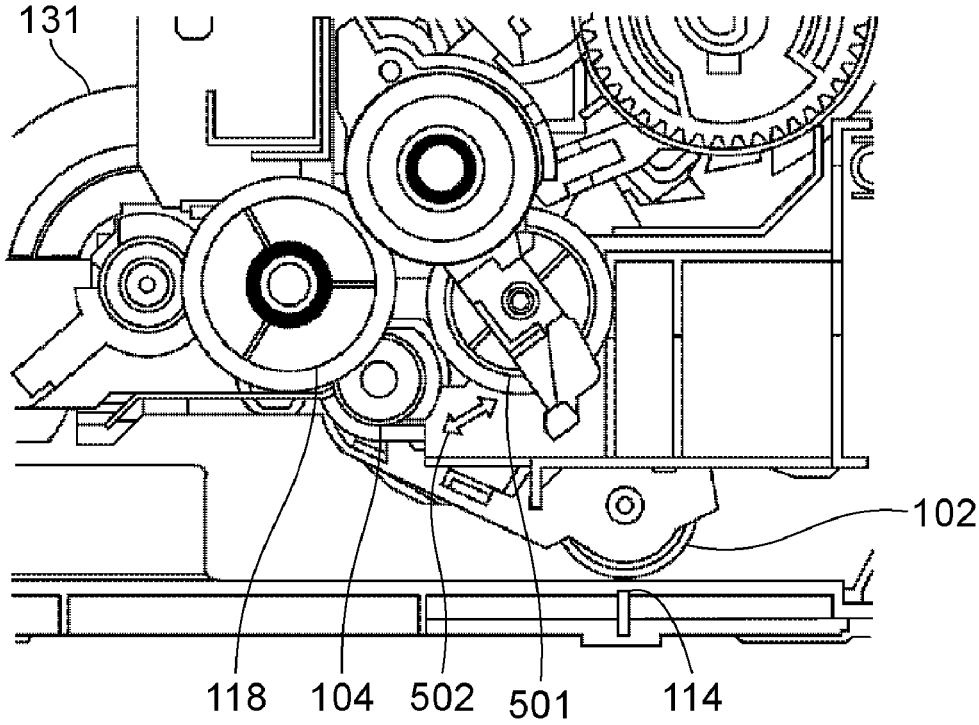
FIGS. 5A and 5B are partial views illustrating a sheet feed roller and a swing arm in the exemplary embodiment of the present invention.

The construction of a sheet feed unit is now described with reference to FIGS. 5A and 5B. FIG. 5A is a view of the sheet feed roller 102, and FIG. 5B is a view of the swing arm 101.

FIG. 5A shows a state where a transmission gear 501 contacts the gear 104. This state represents a state where the sheet feed roller 102 can be rotated, and it corresponds to a state P2 in FIG. 5B. When the LF motor is rotated in that state, the recording medium in the tray 114 can be picked up. A gear 118 transmits the driving force of the LF motor to a gear mounted to the swing arm 101.

Figure 5B:
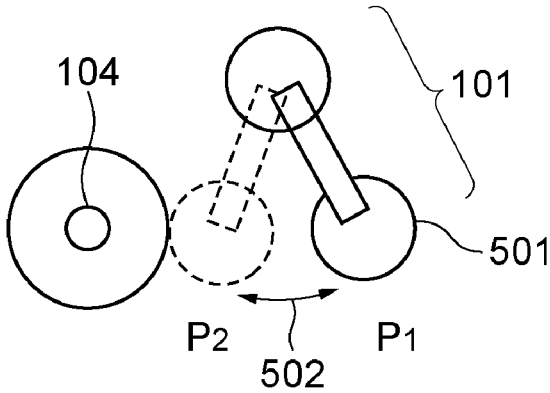

As shown in FIG. 5B, the swing arm 101 is moved between positions P1 and P2 in directions denoted by a double-headed arrow 502 in accordance with the driving of the LF motor.

Figure 4:
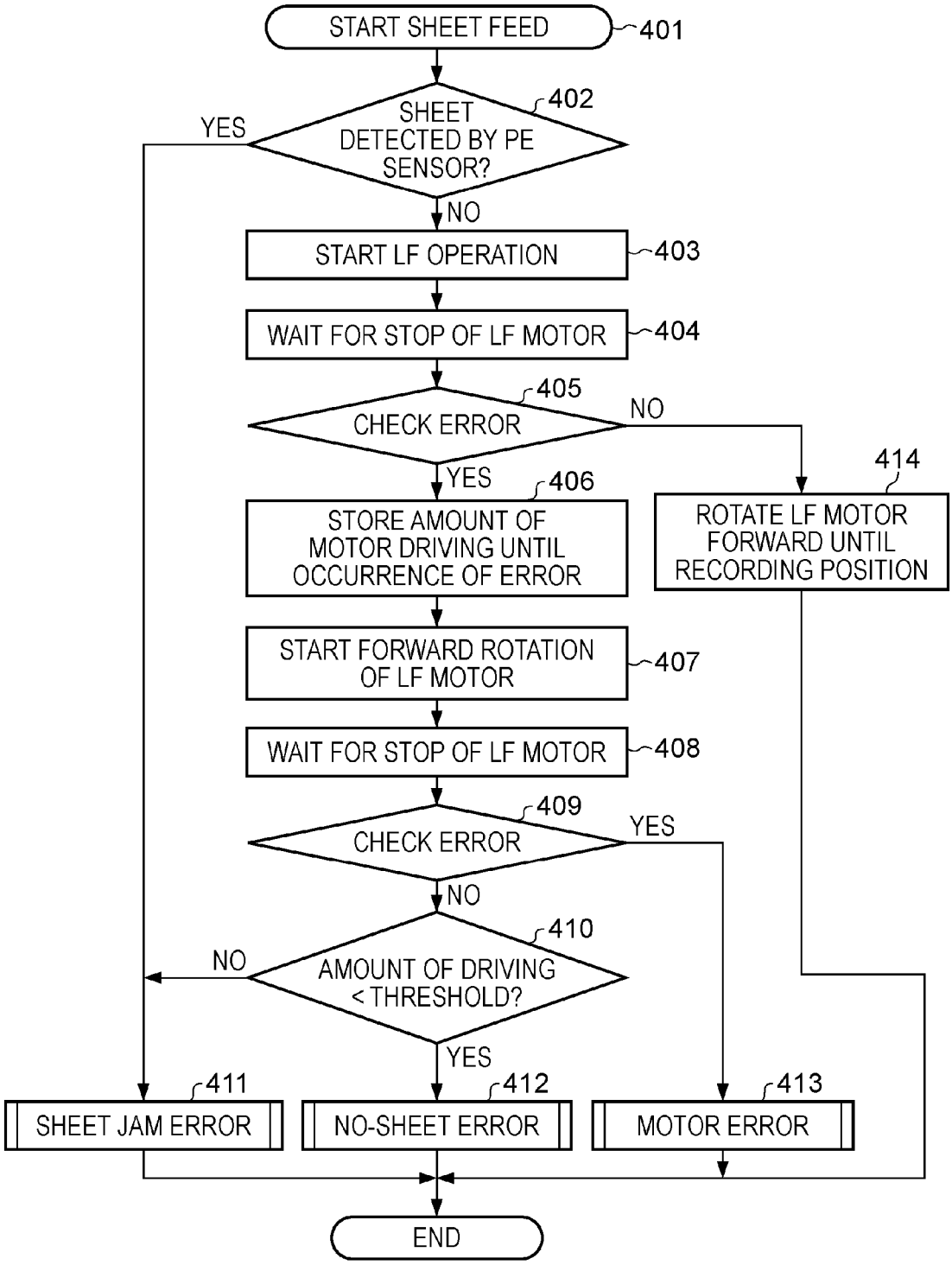
FIG. 4 is a flowchart showing a control flow in the exemplary embodiment of the present invention.

When the LF motor is rotated backward in 403 of FIG. 4, the swing arm 101 is moved from the position P1 to the position P2. Also, when the LF motor is rotated forward in 407 (described later) of FIG. 4, the swing arm 101 is moved from the position P2 to the position P1.

Thus, the sheet feed roller and the conveying roller share the same motor as a driving source. Stated another way, by operating the LF motor in accordance with a preset sequence, it is possible to rotate both the sheet feed roller and the conveying roller, or only the conveying roller as per the sequence.

Returning to FIG. 4, the recording medium picked up from the tray 114 passes the PE sensor 133. The PE sensor 133 detects the leading end of the recording medium conveyed by the sheet feed roller 102. After the sheet feed operation is performed by the sheet feed roller 102 in a predetermined amount (corresponding to 2400 slits of the encoder 131) from the timing of detecting the leading end of the recording medium, the rotation of the sheet feed roller 102 is stopped. At that time, the leading end of the recording medium reaches the conveying roller 115. At the same time, the leading end of the recording medium is abutted against the conveying roller 115 and the pinch roller 116.

While an amount Xslit by which the recording medium is conveyed in the above step corresponds to the distance from the PE sensor to the position where the leading end of the recording medium is abutted against both the rollers, it is set to a proper value depending on the kind and the size of the recording medium.

In 404, the control unit waits for the stop of the LF motor. In 405, an error check is performed.

An error is determined using information obtained by the motor controller 205 in 405. Stated another way, the error determination is executed based on information obtained from the encoder. The number of slits of the encoder (i.e., the number of pulse signals) per unit time is obtained from the encoder information and is used for the determination.

More specifically, the number of pulse signals corresponding to the number of slits and output from the encoder is counted and a value counted for a preset period is evaluated. The number of pulses can be replaced with another suitable value representing the position information of the recording medium. For example, the position information is latched per 1 msec and an amount of change in the count value of a position information counter during a period of 500 msec is measured. The measurement of the amount of change in the count value is repeated per 500 msec. If a value of the amount of the change is smaller than a threshold, this is determined as indicating an error. If a value of the amount of the change is larger than the threshold, this is determined as indicating no error. Additionally, a register or a memory for holding a history of the amount of change in the count value of the position information counter can also be provided.

A more detailed description is now made with reference to FIG. 8. FIG. 8 is a table listing count values in three periods of 500 msec, which represent the position information described above. Time lapses in the order of the period 1, the period 2, and the period 3. In each of cases A, B and C, the LF motor is rotated in amount corresponding to 24000 slits of the encoder. The threshold used for determining the occurrence of an error is set to 50. Based on respective counted slit numbers, it is possible to determine the case (A) where the sheet feed operation is normally executed (no error), the case (B) where there is no sheet, and the case (C) where a sheet is jammed. More specifically, in the case A, the count value in each period exceeds the threshold and the sum of the slit numbers in the periods 1-3 is 24000. Therefore, the case A can be determined as indicating that the sheet feed operation is normally executed. In the case B, the slit number in the period 2 is 0, i.e., smaller than the threshold. Further, the LF roller is rotated not at all in the periods 2 and 3. Therefore, the case B can be determined as indicating that there is no sheet. In the case C, the pulse number is smaller than the threshold in the period 3. It is also seen that the amount of rotation of the LF roller in the periods 1-3 is much smaller than the amount in the normal case A. Thus, the occurrence of an error and the error type are determined by monitoring the amount of rotation of the LF roller during the period (or at the timing) in which the sheet feed roller is rotated. Notice that the periods, the slit numbers, and the threshold used for making the determination are herein described merely by way of example and are not limited to the above-mentioned values.

Additionally, the apparatus of this exemplary embodiment is constructed such that the conveying roller is rotated together while the sheet feed roller is rotated.

If the occurrence of an error is determined in 405, the processing flow advances to 406. On the other hand, if the no occurrence of an error is determined in 405, the processing flow advances to 414.

In 414, the LF motor is rotated forward to convey the recording medium by the LF roller. With this conveying operation, the recording medium is conveyed to the recording position. Also, with the forward rotation of the LF motor, the swing arm 101 is moved from the position P2 to the position P1 in FIG. 5B. Accordingly, the driving force is no longer transmitted from the LF motor to the sheet feed roller, and the sheet feed roller is not rotated and is brought into a stopped state.

With the above-described conveying operation, the recording medium abutted against the conveying roller 115 and the pinch roller 116 is conveyed to the recording position and the swing arm 101 is moved to its original position. Thereafter, each time the sheet is scanned for recording by the recording head, the operation of conveying the sheet is performed by the LF roller. Each conveying operation conveys the sheet in amount corresponding to the number of nozzles used for the recording.

If the occurrence of an error is determined in 405, the cause of the error is determined through processing subsequent to 406. In 406, information representing the amount of conveyance (i.e., the amount of rotation or the amount of driving) from the start of the motor driving to the timing of determining the occurrence of the error is stored in a storage unit. Stated another way, the value of the position information counter having been counted up from the start of the driving of the LF motor is stored in the storage unit. Notice that, when the backward rotation of the LF motor is started in 403, the position information counter is set to an initial value 0 in advance.

After rotating the LF motor forward in 407, the control unit waits for stop of the LF motor in 408. The amount of the conveyance performed at that time corresponds to an amount sufficient for the swing arm 101 to return to the initial position.

While the processing of 407 and 408 is executed, the number of pulse signals is counted again to evaluate the count value counted for a preset period. Subsequently, error check is performed in 409. An error is determined using information obtained by the motor controller 205 in 409.

If an error is determined with the motor driving in 403 and an error is not determined with the motor driving in 407 (i.e., No in 409), this is determined as indicating a sheet jam or no sheet. On the other hand, if an error is determined with the motor driving in 403 and an error is determined with the motor driving in 407 as well (i.e., Yes in 409), this is determined as indicating a failure (error) of the motor or the encoder (413).

If the sheet jam or no sheet is determined in 409, the information representing the amount of the conveyance, which is stored in the storage unit, is evaluated in 410.

Based on the information representing the amount of the conveyance and a preset determination value, the sheet jam or no sheet is discriminated from each other. If the amount of the conveyance is smaller than the determination value, this is determined as indicating a no-sheet state (i.e., a state where no recording medium is present in the tray) and no-sheet processing is performed in 412. On the other hand, if the amount of the conveyance is not smaller than the determination value (i.e., larger than the determination value), this is determined as indicating a sheet jam state and sheet jam error processing is performed in 411.

To describe in more detail, the case of "No" in 409 can be regarded as indicating that the recording medium has not been conveyed downward in the conveying direction, but the swing arm has been normally swung. Therefore, it can be determined that the cause of the error is at least not a failure of the encoder sensor or the motor.

In other words, the case of "No" in 409 can be regarded as indicating that the sheet feed roller 102 has not been normally rotated. As known in the art, when the sheet feed roller contacts the tray in the state of no sheet, a rotation load of the sheet feed roller is increased and the sheet feed roller cannot be rotated in a desired amount. Stated another way, when the surface of the sheet feed roller is made of rubber, for example, the rotation load of the sheet feed roller is increased when the sheet feed roller is brought into contact with the tray. Accordingly, even when the same electric power is applied to the motor, the amount of rotation of the sheet feed roller in the state of no sheet is smaller than that in the state where sheets are present in the tray.

On the other hand, in the case of the jam, the sheet feed roller is rotated until the occurrence of the jam. After the occurrence of the jam, however, a resulting load brings the sheet feed roller into a state where the roller cannot be rotated or a state where its rotation speed is reduced. In such a case, as known the art, the sheet feed roller can be rotated in a certain amount until the sheet comes into the jammed state.

Taking account into the above discussion, the value used for the determination in 410 is set to such a value as enabling the sheet jam or no sheet to be discriminated from each other. In practice, the determination value is set in advance depending on the apparatus construction, the kind of the recording (printing) medium, etc.

Thus, by monitoring the driving state (such as the speed change and the timing at which the speed change has occurred) of the conveying roller when the sheet feed roller is driven, the cause of an error in the driving of the sheet feed roller can be determined.

Other Exemplary Embodiments

The scheme of the conveying control described in the above exemplary embodiment is not limited in application to a recording apparatus, e.g., a printer, and it can also be applied to an image inputting apparatus, e.g., a scanner.

Further, the method of switching over the transmission of the driving force of the DC motor to the sheet feed roller through the transmission unit is also not limited to the one used in the above exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2006-186913 filed Jul. 6, 2006, which is hereby incorporated by reference herein in its entirety.

What is claimed is:

1. A conveying device including a sheet feed roller and a conveying roller which are driven by a DC motor, and controlling the DC motor based on information obtained from an encoder mounted to the conveying roller, the conveying device comprising:

a transmission unit having a transmission state in which a driving force transmitted from the DC motor for driving the conveying roller is transmitted to the sheet feed roller and a non-transmission state in which the driving force is not transmitted to the sheet feed roller, the transmission unit being configured to switch between the transmission state and the non-transmission state based on a rotating direction of the DC motor;

a first driving unit configured to drive the DC motor in a first amount of driving in a first direction to convey a sheet up to the conveying roller when the transmission unit is in the transmission state;

a counting unit configured to count a number of slits of the encoder;

a first determining unit configured to determine the occurrence of an error with respect to the sheet feed roller based on a count value counted by the counting unit during the driving of the first driving unit;

a second driving unit configured to drive the DC motor in a second amount of driving in a second direction opposed to the first direction to convey the sheet up to a position downstream of the conveying roller in a conveying direction when no error is determined by the first determining unit;

a third driving unit configured to drive the DC motor in a third amount of driving in the second direction when the occurrence of an error is determined by the first determining unit; and a second determining unit configured to determine one of a plurality of error types based on the count value counted by the counting unit during the driving of the first driving unit and the count value counted by the counting unit during the driving of the third driving unit, wherein the first determining unit makes the determination based on the count value counted per unit time by the counting unit during the driving of the first driving unit.

2. The conveying device according to claim 1, wherein the error includes at least one of a jam, no sheet, a motor error, and an encoder error.

3. A conveying device including a sheet feed roller and a conveying roller which are driven by a DC motor, and controlling the DC motor based on information obtained from an encoder mounted to the conveying roller, the conveying device comprising:

a transmission unit having a transmission state in which a driving force transmitted from the DC motor for driving the conveying roller is transmitted to the sheet feed roller and a non-transmission state in which the driving force is not transmitted to the sheet feed roller, the transmission unit being configured to switch between the transmission state and the non-transmission state based on a rotating direction of the DC motor;

a first driving unit configured to drive the DC motor in a first amount of driving in a first direction to convey a sheet up to the conveying roller when the transmission unit is in the transmission state;

a counting unit configured to count a number of slits of the encoder;

a first determining unit configured to determine the occurrence of an error with respect to the sheet feed roller based on a count value counted by the counting unit during the driving of the first driving unit;

a storage unit configured to store the count value counted by the counting unit during the driving of the first driving unit;

a second driving unit configured to drive the DC motor in a second amount of driving in a second direction opposed to the first direction to convey the sheet up to a position downstream of the conveying roller in a conveying direction when no error is determined by the first determining unit;

a third driving unit configured to drive the DC motor in a third amount of driving in the second direction when the occurrence of an error is determined by the first determining unit; and a second determining unit configured to determine one of a plurality of error tyres based on the count value counted by the counting unit during the driving of the first driving unit and the count value counted by the counting unit during the driving of the third driving unit, wherein the second determining unit uses the count value stored in the storage unit to make the determination.

4. A conveyance control method for a conveying device including a sheet feed roller and a conveying roller which are driven by a DC motor, and a transmission unit having a transmission state in which a driving force transmitted from the DC motor for driving the conveying roller is transmitted to the sheet feed roller and a non-transmission state in which the driving force is not transmitted to the sheet feed roller, the transmission unit being configured to switch between the transmission state and the non-transmission state depending on a rotating direction of the DC motor, thus controlling the DC motor based on information obtained from an encoder mounted to the conveying roller, the conveyance control method comprising:

driving the DC motor in a first amount of driving in a first direction to convey a sheet up to the conveying roller when the transmission unit is in the transmission state;

counting a first number of slits of the encoder;

determining the occurrence of an error with respect to the sheet feed roller based on the first number of slits counted per unit time;

storing the first number of slits counted in a storage unit;

driving the DC motor in a second amount of driving in a second direction opposed to the first direction to convey the sheet up to a position downstream of the conveying roller in a conveying direction when no error is determined;

driving the DC motor in a third amount of driving in the second direction when the occurrence of an error is determined;

counting a second number of slits of the encoder;

reading the first number of slits counted from the storage unit; and determining one of a plurality of error types based on the first number of slits counted and the second number of slits counted.

5. A recording apparatus including a sheet feed roller and a conveying roller which are driven by a DC motor, and controlling the DC motor based on information regarding an amount of rotation of the conveying roller to record an image on a recording medium by using a recording head, the recording apparatus comprising:

a transmission unit having a transmission state in which a driving force transmitted from the DC motor for driving the conveying roller is transmitted to the sheet feed roller and a non-transmission state in which the driving force is not transmitted to the sheet feed roller, the transmission unit being configured to switch between the transmission state and the non-transmission state depending on a rotating direction of the DC motor;

a first driving unit configured to drive the DC motor in a first amount of driving in a first direction to convey a recording medium in a sheet feed tray up to the conveying roller by the sheet feed roller when the transmission unit is in the transmission state;

a first determining unit configured to determine the occurrence of an error with respect to the sheet feed roller based on an amount by which the conveying roller is rotated per unit time during the driving of the first driving unit;

a second driving unit configured to drive the DC motor in a second amount of driving in a second direction opposed to the first direction to convey the recording medium by the conveying roller up to a recording area of the recording head downstream of the conveying roller in a conveying direction when no error is determined by the first determining unit;

a third driving unit configured to drive the DC motor in a third amount of driving in the second direction when the occurrence of an error is determined by the first determining unit; and a second determining unit configured to determine one of a plurality of error types based on the amount by which the conveying roller is rotated per unit time during the driving of the first driving unit and an amount by which the conveying roller is rotated per unit time during the driving of the third driving unit, wherein the first determining unit makes the determination based on the count value counted per unit time by the counting unit during the driving of the first driving unit.

* * * * *